US010399200B2

(12) United States Patent
Lipson

(10) Patent No.: US 10,399,200 B2
(45) Date of Patent: Sep. 3, 2019

(54) INTELLIGENT POLISHER/BUFFER WITH SELECTIVE COLOR-MATCHING LIGHT

(71) Applicant: Ronald Lipson, Orchard Lake, MI (US)

(72) Inventor: Ronald Lipson, Orchard Lake, MI (US)

( * ) Notice: Subject to any disclaimer, the term of this patent is extended or adjusted under 35 U.S.C. 154(b) by 0 days.

(21) Appl. No.: 15/386,657

(22) Filed: Dec. 21, 2016

(65) Prior Publication Data

US 2018/0170321 A1 Jun. 21, 2018

(51) Int. Cl.

| | |
|---|---|
| ***B24B 1/00*** | (2006.01) |
| ***B24B 23/02*** | (2006.01) |
| ***B24B 23/04*** | (2006.01) |
| *F21V 33/00* | (2006.01) |
| *F21V 23/04* | (2006.01) |
| *F21Y 115/10* | (2016.01) |
| *F21Y 113/13* | (2016.01) |
| *B24D 7/14* | (2006.01) |
| *B24D 7/18* | (2006.01) |

(52) U.S. Cl.

CPC ..... *B24B 1/00* (2013.01); *B24B 23/028* (2013.01); *B24B 23/04* (2013.01); *B24D 7/14* (2013.01); *B24D 7/18* (2013.01); *F21V 23/0414* (2013.01); *F21V 33/0084* (2013.01); *F21Y 2113/13* (2016.08); *F21Y 2115/10* (2016.08)

(58) Field of Classification Search

CPC ..... B24D 7/18; B24D 18/00; B24D 18/0009
See application file for complete search history.

(56) References Cited

U.S. PATENT DOCUMENTS

| | | | | |
|---|---|---|---|---|
| 9,818,919 | B2 * | 11/2017 | Lowes | H01L 33/54 |
| 2004/0103490 | A1 * | 6/2004 | Long | A47L 11/125 15/22.1 |
| 2009/0056042 | A1 * | 3/2009 | Pena | B08B 1/04 15/3 |
| 2009/0124184 | A1 * | 5/2009 | Greer | B24B 23/02 451/449 |
| 2015/0099440 | A1 * | 4/2015 | Valentini | B24B 23/03 451/548 |
| 2015/0204528 | A1 * | 7/2015 | Zeng | H05B 33/0803 362/363 |

* cited by examiner

*Primary Examiner* — Michael D Jennings
(74) *Attorney, Agent, or Firm* — John G. Posa; Belzer PC

(57) ABSTRACT

An improved buffer/polisher for treated painted surfaces, including painted cars, automobiles, vehicles and the like, including surfaces with state-of-the-art, hardened coats of paint or finish, includes built-in source of illumination, disposed on the housing, direct light downwardly and toward the work surface. The source of illumination emits light with a color temperature above 4500 degrees Kelvin, more preferably at 5000 degrees Kelvin or greater. Even more preferably, the source of illumination is switchable to include light with a color temperature including 5000 degrees Kelvin (mimicking daylight at 10-11 am) and 6500K (mimicking daylight at 12 noon). The source of illumination may comprise one or more LEDs, and the polishing pad may assume a random orbital motion.

11 Claims, 3 Drawing Sheets

INTELLIGENT POLISHER/BUFFER WITH SELECTIVE COLOR-MATCHING LIGHT

FIELD OF THE INVENTION

This invention relates to painted surface polishing and buffing and, more particularly, to an intelligent polisher with multiple surface illumination settings.

BACKGROUND OF THE INVENTION

Polishing small defects in the painted surfaces of automotive and other vehicles is a critical operation. Often vehicle surfaces are compromised during the painting process, and cars with visible scratches are not acceptable. There is no exact science to achieving an acceptable result other than providing a skilled operator with an air polisher and a pad. Polish is applied to the pad, the trigger is depressed, and after a few seconds the scratches usually go away.

There are basically two different types of paint polishers or buffers: rotary and orbital. Rotary units are still the most popular, as they are very effective at removing deep scratches, and overall paint polishing. However, these machines can remove paint from a vehicle very quickly, requiring careful use of the variable speed control. Orbital polishers, which operate by oscillating numerous times per second in pseudo-random directions, are a safer option for painted surface buffing.

Regardless of the system used, new paint system chemistry is making vehicle surface polishing much more difficult. In particular, new paint is harder and it takes longer to remove the defects. If more aggressing procedures are used the process can "go too far" and remove too much of the painted surface.

Lighting of the surface to be polished or buffed is therefore extremely important. In particular, correct color temperature for surface lighting is essential to providing an accurate representation of "true color" and surface condition. If a light source casts a wavelength other than "pure white" onto a painted surface, the true color and condition of paint defects cannot be accurately perceived. As such, color temperatures of about 4500 deg. K or below are undesirable for surface polishing, since warm tones of light are cast onto the surface. Thus, while incandescent lighting, in the range of 2700K-3300K, provides warm tones for household environments it is a poor choice for surface detailers. Halogen light at ~2700K is one of the worst sources for bringing out painted surface defects, and while compact fluorescent lighting CFL at ~2700-4200K is better but it can still generate undesirable color tinting.

Lighting at color temperatures between 5000K-6500K is much better at showing defects and flaws in painted surfaces, since this range is closer to sunlight. While light at 5000K is better at identifying true color since it is closest to "pure white," the intensity of light at 6500K is often better at revealing surface conditions and flaws. However, a 6500K light will appear significantly cooler or bluish. Indeed, it has been found that light of around ~5600K is considered a standard for observing the true color and condition of painted surfaces.

While there are power-driven polishers with means for illuminating the work surface, such devices are not intended for painted surfaces, nor do they provide an appropriate light source. U.S. Pat. No. 2,778,043, for example, describes a motor-driven polisher for shoes including a rotary brush extending from a hand-held housing. The housing includes a downwardly opening light bulb shield. The bulb "could be a flashlight bulb or the like," and is engageable in a bulb socket that is mounted in confronting recesses formed in portions of the housing. Clearly such apparatus would not be suitable for polishing or buffing modern painted vehicle surfaces.

SUMMARY OF THE INVENTION

This invention resides in an improved buffer/polisher for treated painted surfaces, including painted cars, trucks and other vehicles including boats, and the like, including surfaces with state-of-the-art, hardened coats of paint or finish.

The tool comprises a hand-held, elongated housing including an electric motor defining an axis of rotation. While rotary tools are applicable, in preferred embodiments the tool drives a random-orbital polishing pad of any suitable diameter from 3 to 6 inches, more or less.

Unique to the invention, a built-in source of illumination, disposed on the housing, direct light downwardly and toward the work surface. The source of illumination emits light with a color temperature above 4500 degrees Kelvin, more preferably at 5000 degrees Kelvin or greater. Even more preferably, the source of illumination is switchable to include light with a color temperature including 5000 degrees Kelvin, and light with a color temperature including 6500 degrees Kelvin. The source of illumination may comprise one or more light-emitting diodes (LEDs).

The tool may further include a speed control and a dimmer to control the intensity of light emitted by source of illumination.

DETAILED DESCRIPTION OF THE PREFERRED EMBODIMENTS

Prior to describing the invention in detail, certain definitions will be provided as follows:

1) A Lumen of light refers to a measure the relative intensity or brightness from a single source, such as the amount of light generated by one candle.
2) The Kelvin Scale is an extension of the Celsius scale based on the color of the light emitted from a hypothetical "black body." The Kelvin scale refers to the amount of energy needed to transform a black body into a corresponding color expressed with a numerical value in (degrees) K.
3) Color Temperature refers to the perceived color of a light source, as interpreted by the human eye, measured in the Kelvin scale. Colors with lower Kelvin temperatures are considered "warm," as they containing orange to red light, whereas colors with higher Kelvin temperatures are considered "cool" (i.e., more blue light).
4) Daylight is taken to mean "normal daylight" at mid-day, when the sun is at its highest point in the sky, with an effective color temperature of about 5578K.
5) Color Rendering Index (CRI) is a scale from 0 to 100 percent indicating how accurate a given light source is at rendering color when compared to a reference light source. The higher the CRI, the better the color rendering ability.

This invention is directed to an intelligent buffer/polisher with a built-in illuminator optimized for revealing scratches and surface defects, particularly in painted surfaces. In the preferred embodiment, the tool is a hand-held orbital polisher, and the illuminator is an LED illuminator that can be switched between color temperatures optimized for identifying true color, surface conditions and flaws. In the most preferred embodiment, the LEDs are switchable between light having a color temperature including 5000K and light having a color temperature including 6500K.

Figure 1:
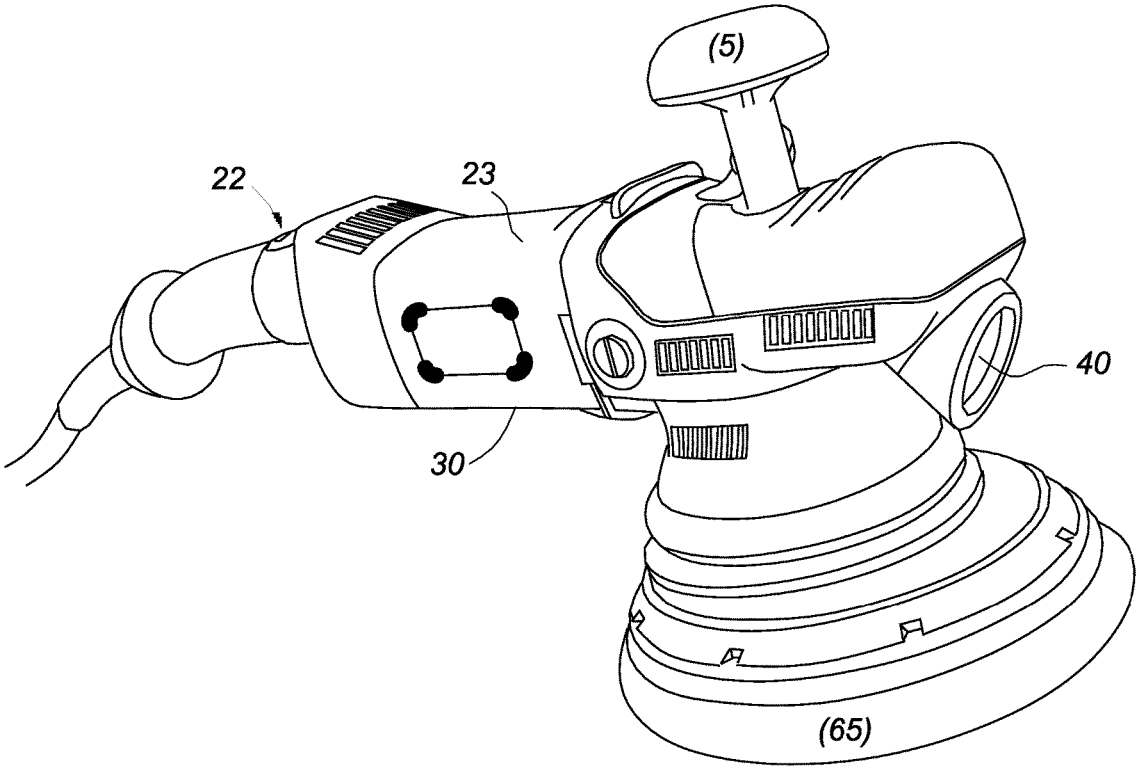
FIG. 1 is an oblique drawing illustrating a preferred embodiment of the invention.

FIG. 1 is an oblique representation of the tool, which includes a hand-held body including housing pieces 23, 30, and knob 5. An electric motor is disposed in the handle portion, and a gear box generally under the knob changes the axis of rotation from horizontal top downward toward backing plate 65. A series of counter weights between the gear box and backing plate 65 convert the axial rotation into a pseudo-random orbital motion. The backing plate 65 includes a surface configured to receive polishing paper, typically through a hook-and-loop (i.e., Velcro®) attachment mechanism.

Figure 2:
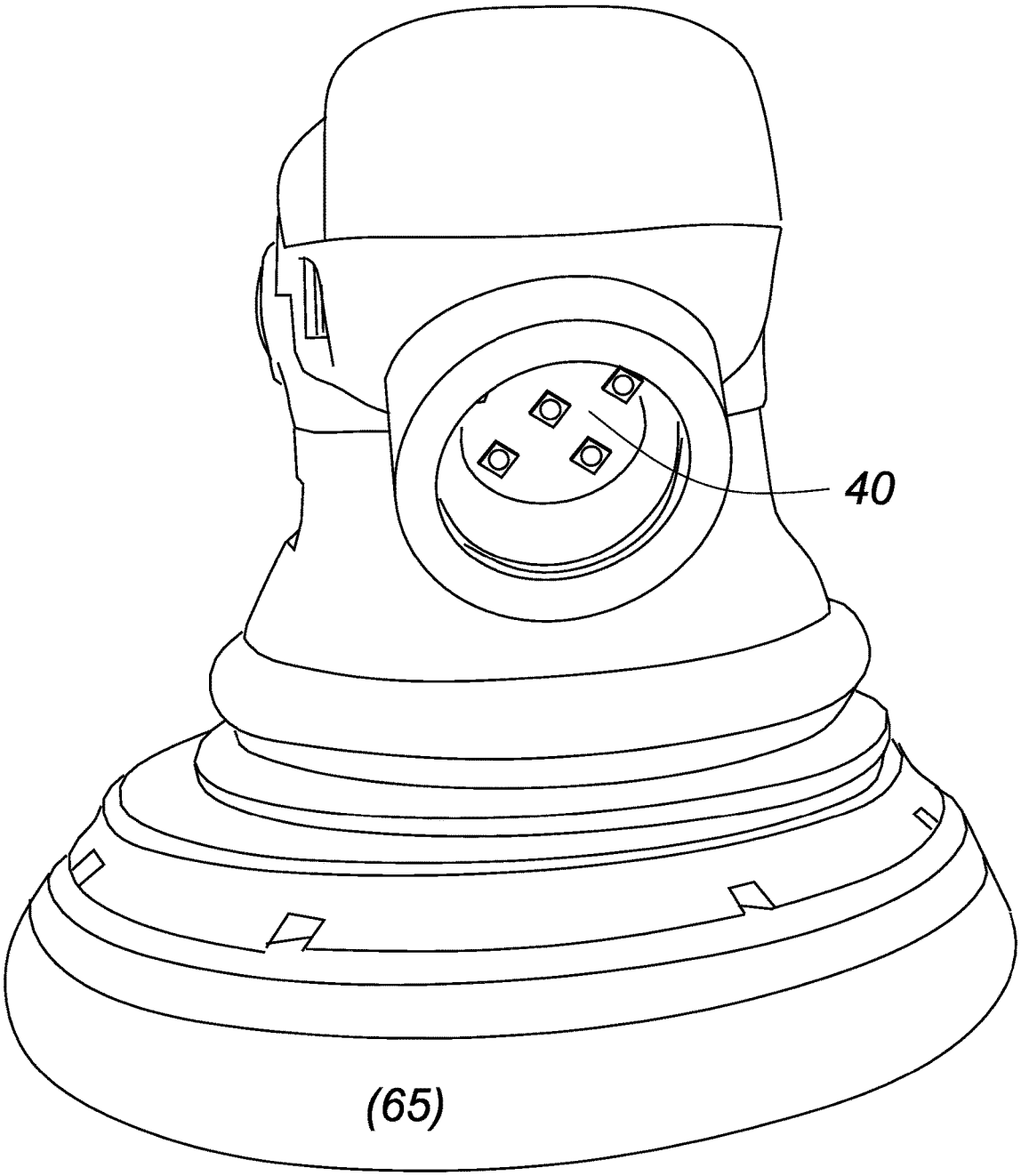
FIG. 2 is a front view showing the LED module.

The front of the tool supports an LED module 40. As better seen in FIG. 2, the module includes a plurality of individual LED chips, some operative to emit light including a color temperature of 5000K and others operative to emit light having a color temperature including 6500K. In the preferred embodiment, one set of lights produces illumination centered on 5000K, and a second set of lights produces illumination centered on 6500K.

A switch toward the front of the unit enables a user to choose between either of the color temperatures. In the preferred embodiment, the switch is a pushbutton switch that cycles between light and 5000K, light at 6500K, and dimmed light at 6500K. In other embodiments, the switch cycles between light and 5000K, dimmed light at 5000K, light at 6500K, and dimmed light at 6500K. While simultaneous light at both color temperatures is possible it may be confusing to a user. However, in accordance with a further alternative embodiment, the light may automatically transition between light at 5000K to light at 6500K at a slow and gradual period on the order of a few seconds or more, thereby allowing the user to visualize true color and defects without having to manually switch between color temperatures.

An ON/OFF switch and rotary speed-control dial in the region of 22 enables a user to activate the tool and adjust the speed of rotation regardless of the selected color temperature(s).

The built-in light module is designed and positioned to illuminate an area above and to each side of the polishing pad surface. The strategic placement of the light is very important. Specifically, approximately 75 percent of the concentration of lumens is directly above the polishing pad. It has been discovered that the placement shown above the pad represents a user's primary focal point. The light adjustment switch provides for 1800 lumens spread over 180 degrees. The output is then switchable between 5000 K (mimicking daylight at 10-11 am) and 6500K (mimicking daylight at 12 noon). The CRI (color rendering index) at both color temperatures is 97, or nearly ideal.

Figure 3:
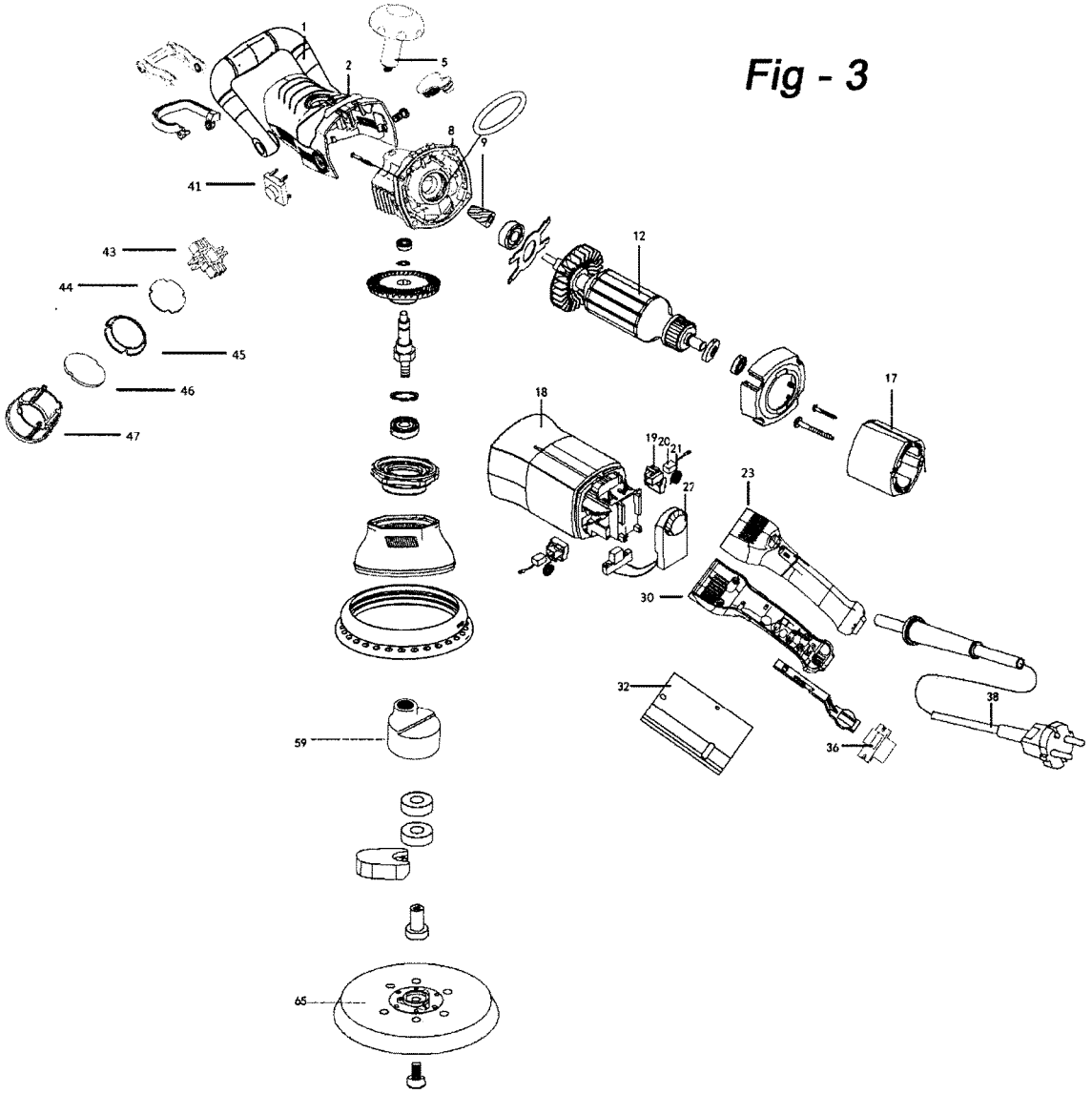
FIG. 3 is an exploded view describing major components.

FIG. 3 is an exploded view of the tool calling out major components. Note that every components is not represented, and not all components shown are, or need to be, identified to communicate the invention. The housing of the tool comprises components 18, 23, 30. The motor in the handle comprises rotor 12 and stator 17. Electrical cord 38 feeds power to electrical components 19, 20, 21, 22 through power switch 36. Item 32 refers to electrical control board that operates the LED module.

The rotor turns gear 9 in gear box 8 which, in turn, drives gear 50. Gear 50 drives a series of mechanical components and counterweights such as 59 causing backing plate to assume a random orbital motion. The LED illuminator includes components 41, 43, 44, 45, 46 and 47. Part 44 is the substrate that holds the LEDs and part 41 represents the color temperature selection switch. Knob 5 may be unscrewed if not desired, and handle 1 which connects to shroud 2 may be used instead to steady the tool during use.

The invention claimed is:

1. An improved polisher adapted to remove scratches and imperfections in painted surfaces, comprising:

a housing defining a front, a back, a top and a bottom;

an elongated handle extending from the back of the housing;

a motor within the housing defining an axis of rotation;

a circular polishing pad coupled to the motor and extending from the bottom of the housing, the polishing pad being adapted to receive a sheet of circular polishing paper to treat a work surface;

a source of illumination disposed on the front of the housing in opposing relation to the elongated handle extending from the back of the housing, the light from the source being directed outwardly and downwardly to provide unobstructed illumination of the work surface; and wherein the source of illumination emits light with a color temperature above 4500 degrees Kelvin to enhance the visualization of scratches and imperfections in the work surface as they are removed by the polisher.

2. The improved polisher of claim 1, wherein the source of illumination emits light with a color temperature of 5000 degrees Kelvin or greater.

3. The improved polisher of claim 1, wherein the source of illumination is switchable to include light with a color temperature including 5000 degrees Kelvin, and light with a color temperature including 6500 degrees Kelvin.

4. The improved polisher of claim 1, further including a dimmer to control the intensity of light emitted by source of illumination.

5. The improved polisher of claim 1, wherein the source of illumination comprises one or more light-emitting diodes.

6. The improved polisher of claim 1, further including mechanical components causing the polishing pad to assume a random orbital motion.

7. The improved polisher of claim 1, wherein the source of illumination includes at least one first LED having a color temperature of 5000 degrees Kelvin, and at least one second LED having a color temperature of 6500 degrees Kelvin; and a control enabling a user to select between the first and second LED.

8. The improved polisher of claim 1, further including a dimmer to control the intensity of light emitted by source of illumination.

9. The improved polisher of claim 1, further including a user-graspable knob extending from the top of the housing.

10. The improved polisher of claim 1, further including a power cord extending from a proximal end of the elongated handle.

11. The improved polisher of claim 1, wherein the motor is operated by a rechargeable battery disposed in the housing or elongated handle.

* * * * *